US011371671B2

(12) United States Patent
Taudt et al.

(10) Patent No.: US 11,371,671 B2
(45) Date of Patent: Jun. 28, 2022

(54) MOTOR VEHICLE HEADLAMP HAVING A SHIELDING SCREEN FOR SHIELDING INCIDENT SOLAR RADIATION

(71) Applicant: ZKW Group GmbH, Wieselburg (AT)

(72) Inventors: Lukas Taudt, Wieselburg (AT); Nina Brauner, Wieselburg (AT); Mathias Schragl, Zarnsdorf (AT); Christoph Längauer, Lunz am See (AT)

(73) Assignee: ZKW Group GmbH, Weiselburg (AT)

( * ) Notice: Subject to any disclaimer, the term of this patent is extended or adjusted under 35 U.S.C. 154(b) by 0 days.

(21) Appl. No.: 16/969,789

(22) PCT Filed: Jan. 22, 2019

(86) PCT No.: PCT/EP2019/051435
§ 371 (c)(1),
(2) Date: Aug. 13, 2020

(87) PCT Pub. No.: WO2019/158319
PCT Pub. Date: Aug. 22, 2019

(65) Prior Publication Data

US 2021/0003263 A1 Jan. 7, 2021

(30) Foreign Application Priority Data

Feb. 15, 2018 (EP) ..... 18156939

(51) Int. Cl.
*F21S 41/43* (2018.01)
*F21S 41/143* (2018.01)
(Continued)

(52) U.S. Cl.
CPC ..... *F21S 41/43* (2018.01); *F21S 41/143* (2018.01); *F21S 41/153* (2018.01);
(Continued)

(58) Field of Classification Search
CPC ..... F21S 41/43; F21S 41/255; F21S 41/153; F21S 41/143; F21S 41/40; F21S 41/435;
(Continued)

(56) References Cited

U.S. PATENT DOCUMENTS

2008/0239740 A1 10/2008 Nakada et al.
2010/0226144 A1 * 9/2010 Stade ..... F21S 41/143
(Continued)

FOREIGN PATENT DOCUMENTS

DE 102013214990 A1 2/2015
DE 102014220614 A1 * 4/2015 ..... F21S 45/10
(Continued)

OTHER PUBLICATIONS

International Search Report for PCT/EP2019/051435, dated May 10, 2019 (2 pages).
(Continued)

*Primary Examiner* — Erin Kryukova
(74) *Attorney, Agent, or Firm* — Eversheds Sutherland (US) LLP

(57) ABSTRACT

The invention relates to a motor vehicle headlamp having a shielding screen (9) for shielding incident solar radiation, wherein the shielding screen is arranged between a lighting unit (2) having at least one light source (3), and a projection optics (8). Said shielding screen has a light outlet aperture for light radiated by the light unit to the front, wherein the light emitted by the lighting unit is projected into the traffic space as a light image by means of the projection optics, and the shielding screen is located outside the focal plane of the projection optics. On the border (13) of the light outlet aperture (10) of the shielding screen (9), deflective structures (14, 15, 16, 17, 18, 19) are formed, a least in some areas, which lead to a deflection of scattered light that is emanating from the lighting unit and is undesirable in the light image.

12 Claims, 3 Drawing Sheets

Figure 1:
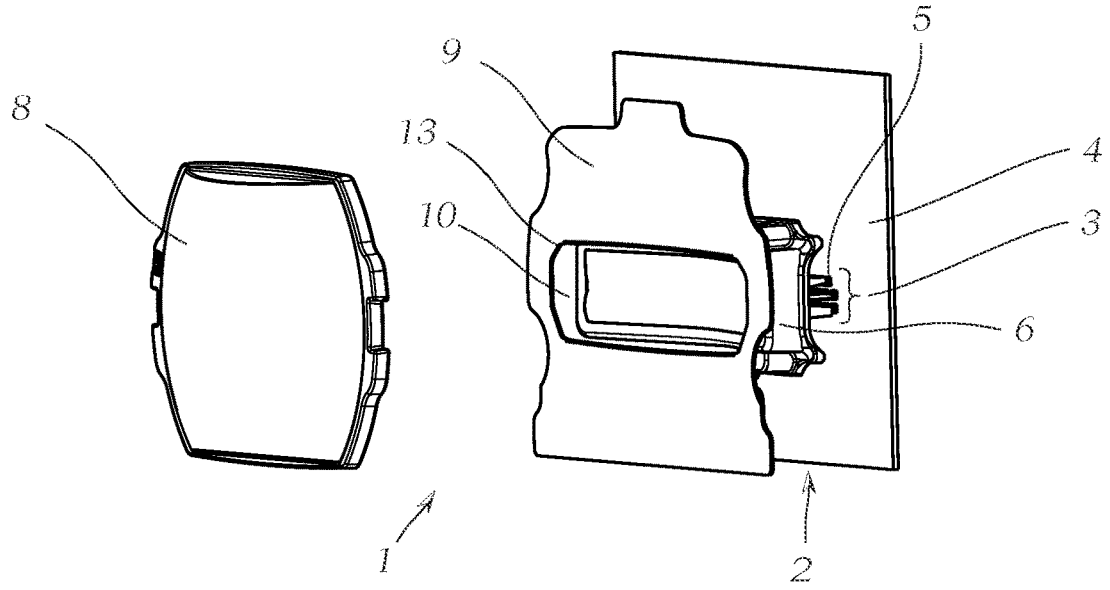

(51) Int. Cl.

| | |
|---|---|
| ***F21S 41/255*** | (2018.01) |
| ***F21S 41/153*** | (2018.01) |
| ***F21S 45/10*** | (2018.01) |
| ***F21Y 115/10*** | (2016.01) |

(52) U.S. Cl.
CPC ..... *F21S 41/255* (2018.01); *F21S 45/10* (2018.01); *F21Y 2115/10* (2016.08)

(58) Field of Classification Search
CPC ..... F21S 41/47; F21S 45/10; F21Y 2115/10; F21V 29/15
See application file for complete search history.

(56) References Cited

U.S. PATENT DOCUMENTS

2011/0292669 A1 12/2011 Albou et al.
2013/0250600 A1* 9/2013 Sekiguchi ..... F21S 41/32 362/539
2017/0059109 A1* 3/2017 Matsumoto ..... F21S 41/255
2017/0276309 A1 9/2017 Nakazawa et al.
2019/0070997 A1* 3/2019 Mouri ..... F21S 41/255
2020/0208800 A1* 7/2020 Abe ..... F21S 41/20

FOREIGN PATENT DOCUMENTS

EP 2420728 A1 * 2/2012 ..... F21S 41/143
EP 2420728 A1 2/2012

OTHER PUBLICATIONS

Search Report for European Application No. 18156939, dated Jun. 1, 2018 (1 page).

* cited by examiner

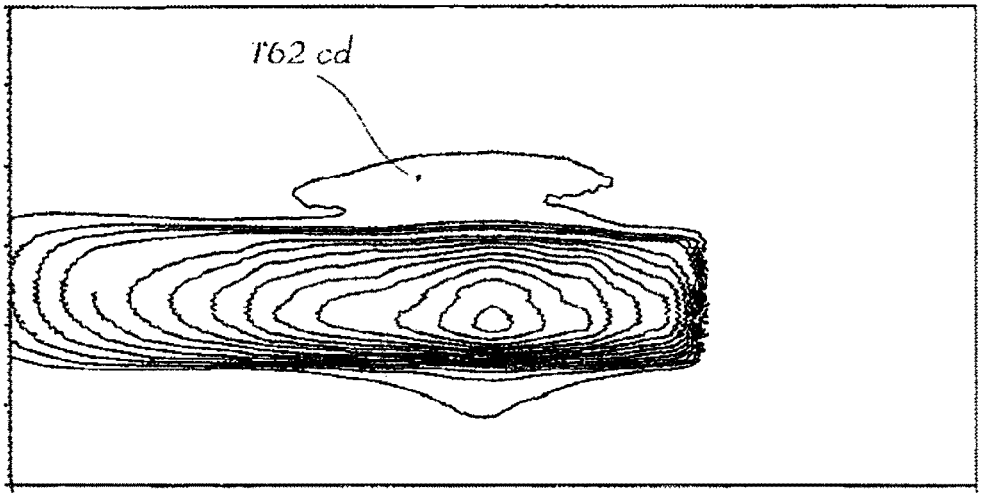
Fig. 8
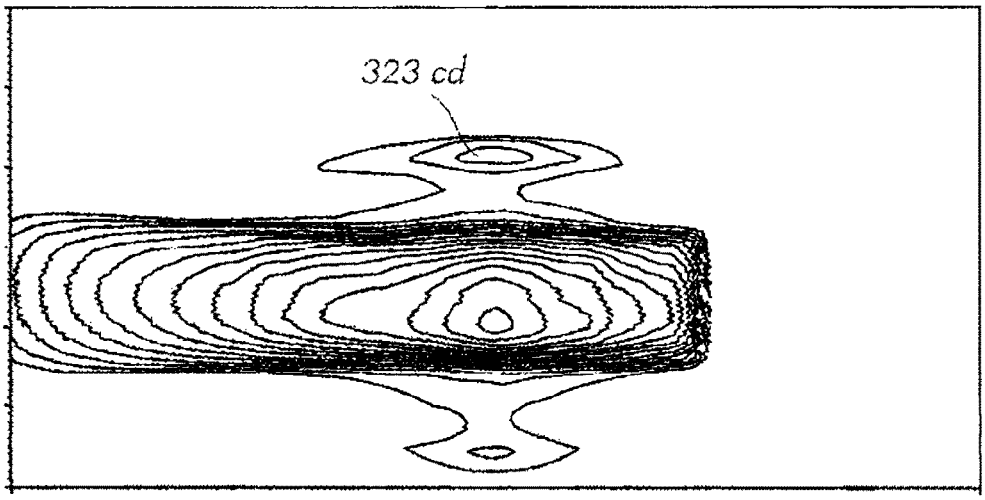
Fig. 9 (Prior Art)
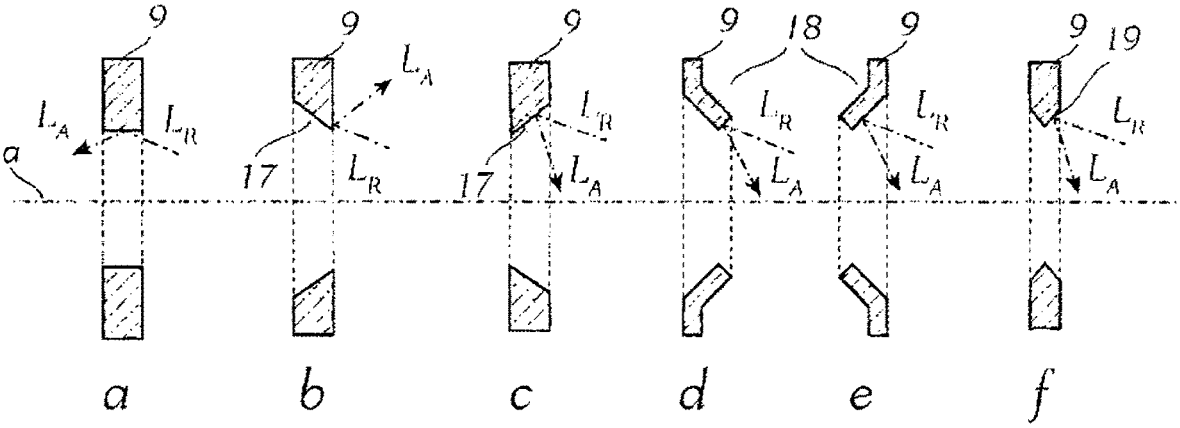
(Prior Art) Fig. 10

MOTOR VEHICLE HEADLAMP HAVING A SHIELDING SCREEN FOR SHIELDING INCIDENT SOLAR RADIATION

The invention relates to a motor vehicle headlamp having a shielding screen for shielding from incident solar radiation, wherein the shielding screen is arranged between a lighting unit, which has at least one light source, and a projection optics optics. Said shielding screen has a light outlet aperture for light radiated by the light unit to the front, wherein the light emitted by the lighting unit is projected into the traffic space as a light image by means of the projection optics optics, and the shielding screen is located outside the focal plane of the projection optics optics.

When a motor vehicle with its headlamps faces the sun, the solar radiation in combination with optical elements of the headlamp, such as lenses for example, can heat parts inside the headlamp so much that irreversible damage occurs due to the so-called burning-glass effect. For example, plastic parts may be burned or melted, or electronic components may be destroyed. Therefore, various measures have been devised to counteract the harmful burning-glass effect. In particular, an attempt have been made to make the rays of the sun located higher over the horizon harmless by means of specially designed screens, wherein a screen of this kind is shown and described, for example, in DE 10 2005 021 704 A1.

Document DE 10 2013 214 990 A1 shows a lens holder in the form of a conical tube, which is provided with a metal coating inside to prevent damage to this lens holder caused by solar radiation. In order to further reduce the heating of the lens holder, it may additionally comprise grooves in the area of the metal coating.

If a shielding screen of the present type is arranged in front of a light unit, e.g. an LED light source module, wherein the shielding screen comprises a light outlet aperture for light radiated by the lighting unit to the front, scattered light occurs as a disturbing side effect at the edges of the light outlet aperture, which was produced normally by punching out of a metal sheet, thereby undesirably influencing the light image projected onto the street. It should be noted that in this description, the term shielding screen is applied to denote a covering used to avoid the burning-glass effect of the sun, wherein this cover does not necessarily have to be made of sheet metal. Rather, the covering may also consist of plastic, and the shielding screen, whether it is made of metal or plastic, may comprise a radiation-absorbing coating so that light or heat radiation is absorbed on the shielding screen.

It is an object of the invention to reduce this effect, thereby improving the quality of the light image.

This object is achieved by means of a motor vehicle headlamp of the above-mentioned type, in which, according to the invention, deflective structures are formed on at least a portion (or portions) of the border of the light outlet aperture of the shielding screen, thus causing a deflection of the undesired scattered light in the light image emitted by the lighting unit.

By virtue of the invention, light emitted by the lighting unit or light source of the headlamp is no longer reflected at the border of the light outlet aperture of the shielding screen towards the projection optics, thus enabling a significant reduction of undesirable scattered light in the light image projected onto the street.

In an embodiment that is simple on manufacturing and technically related level, it may be provided that the border of the light outlet aperture of the shielding screen, at least a portion thereof, comprises a bevelled edge as the deflective structure, wherein the bevel running across the thickness of the shielding screen is tilted towards the optical axis and the lighting unit at a specified angle.

An embodiment is particularly inexpensive and easy to manufacture where the border of the light outlet aperture of the shielding screen is angled in the direction of the lighting unit at least in some portions and is tilted against the optical axis, thereby being angled at a specified angle in an angling.

Another effective embodiment of the invention is distinguished in that the deflective structures are shaped as a plurality of spikes, to deflect disturbing marginal beams coming from the lighting unit. In this case, it has been found to be expedient if 20 to 400 spikes, in particular 50 to 200, spikes, are provided on one side of the border along the longitudinal expansion of the light outlet aperture.

The invention is particularly expedient in the case of a headlamp where an auxiliary optics is arranged in the beam path between the light source and the shielding screen.

From an optical and visually advantageous view, it is favorable if the shielding screen is arranged in front of the focal plane of the projection lens.

The invention also offers special advantages if the light source comprises a number of LEDs arranged in a matrix.

In a tried and tested embodiment, the shielding screen is made of metal. On the other hand, in other cases, it may be advantageous to have the shielding screen made of plastic.

In both cases, it is often recommended for the shielding screen to comprise a radiation-absorbing coating in order to absorb and not reflect light or heat radiation.

Figure 2:
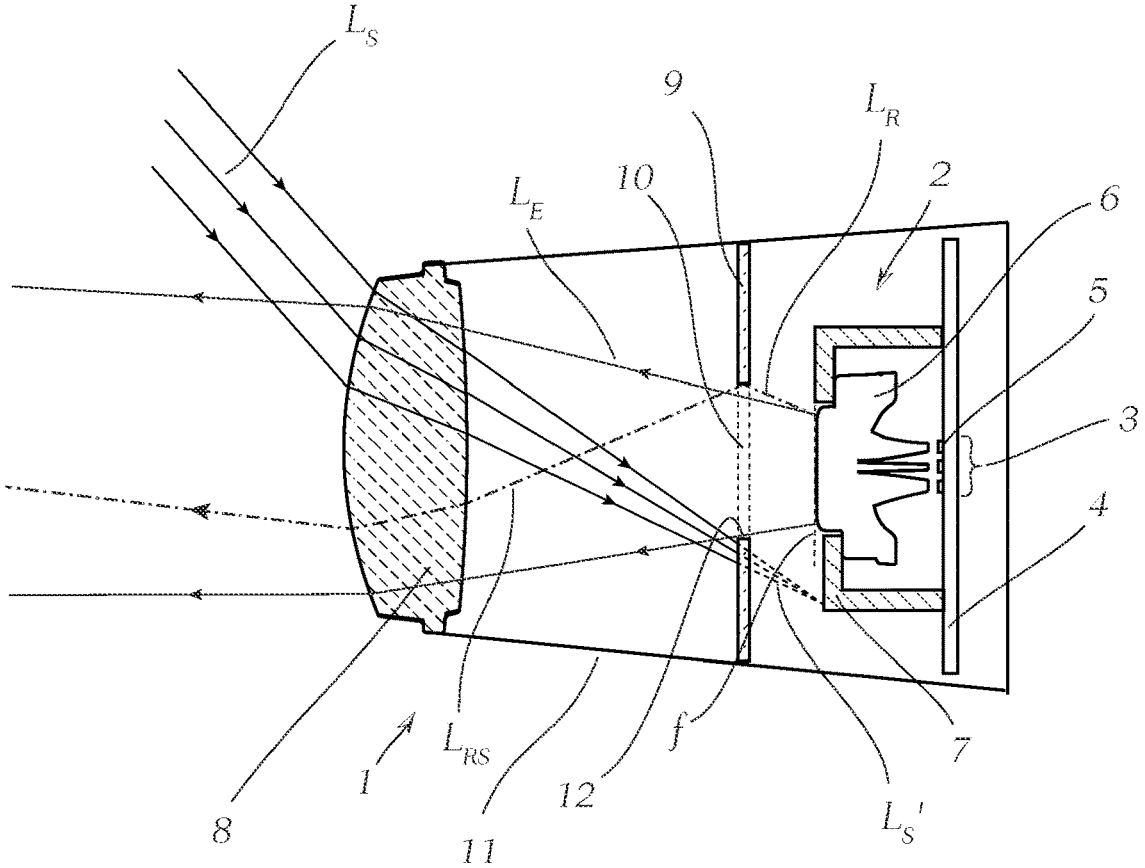
Figure 3:
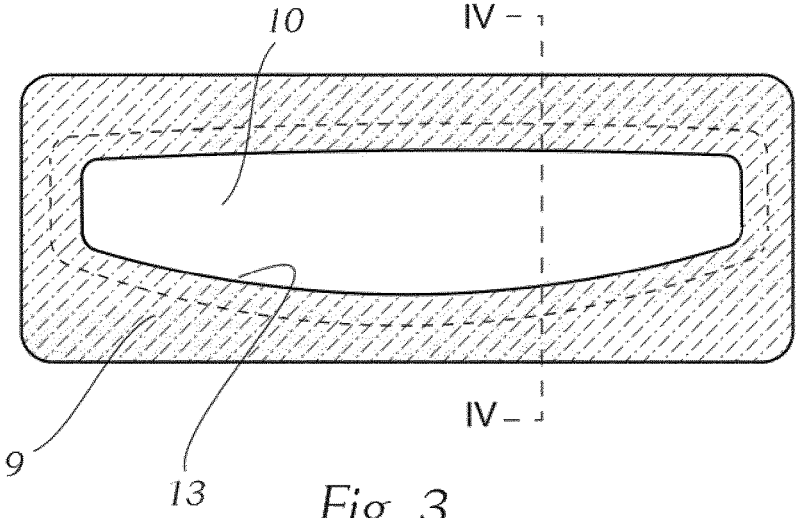
Figure 4:
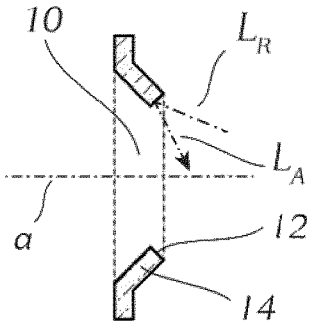
Figure 5:
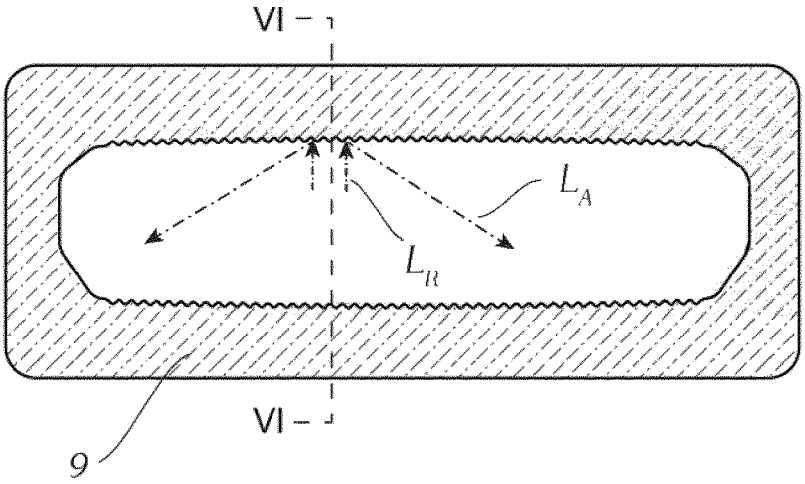

The invention, together with further advantages and its differences to the prior art, is explained in more detail below also using exemplary embodiments and is illustrated in the drawing. The figures show:

FIG. 1 in a schematic and perspective view, components of a headlamp, namely a lighting unit with a shielding screen inserted before it for shielding incident solar radiation and a projection lens, FIG. 2 a schematic section through a headlamp of the present type with the components shown in FIG. 1, wherein several significant beam paths are depicted, FIG. 3 a front view of a shielding screen of a first embodiment of the invention, FIG. 4 a section according to line IV-IV in FIG. 3, showing a deflective structure of the first embodiment, FIG. 5 a front view of a shielding screen of a second embodiment of the invention.

Figure 6:
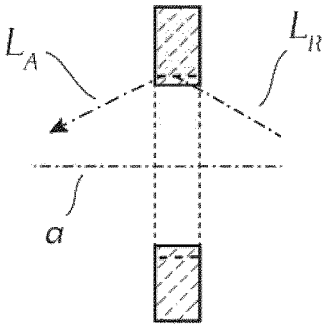
Figure 7:
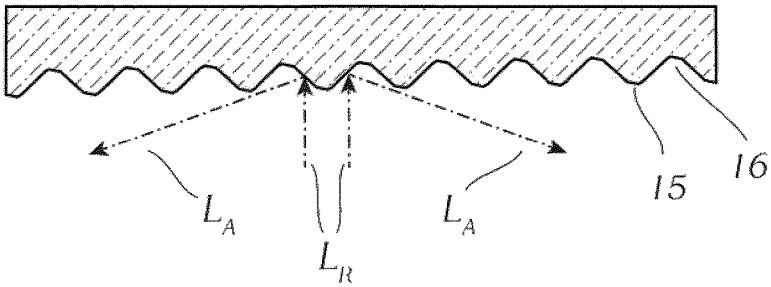

FIG. 6 a section according to line VI-VI of FIG. 5, showing a deflective structure of the second embodiment, FIG. 7 an enlarged detail of the deflective structure in FIG. 6.

FIG. 8 an exemplary light distribution of a headlamp including a shielding screen in accordance with the second embodiment of the invention in accordance with FIG. 5 to 7, FIG. 9 an exemplary light distribution of a headlamp with a shielding screen according to prior art, and FIG. 10*a* to 10*f* sectional views analogous to FIG. 4 formed by shielding screens of different shapes, wherein FIG. 10*a* shows the most recent background art and FIG. 10*b* to 10*f* show embodiments according to the invention.

In the illustrations in accordance with FIG. 1 and FIG. 2 in a schematic view, a headlamp 1 according to the invention can be recognized with its components that are essential for the explanation of the invention, wherein it is clear to the person skilled in the art that a headlamp possesses a plurality of other components (not shown here), such as setting and adjusting devices, electrical supply means and much more. If the term "headlamp" is used in connection with the invention, this term should also include individual projection modules, which may also be included in combination in a superordinate headlamp.

In these and the following figures, same reference numbers are used for the same or similar elements for the sake of simpler explanation and illustration.

The reference numbers used in the claims are only intended to facilitate the legibility of the claims and the understanding of the invention and are in no way affecting the scope of the invention.

Terms relating to the location or orientation, such as "top", "bottom", "front", "below", "above" etc., are used in the description only for simplification and may refer to the illustration in the drawing, but not necessarily to a position during operation or installation.

The headlamp 1 has a lighting unit 2, in which a number of LEDs 5 are arranged in a matrix on a circuit board 4 as a light source 3. The LEDs 5 are preceded by an auxiliary optics 6, which is held by means of a mount 7 here on the printed circuit board 4. The LEDs 5 radiate their light into the light-conducting auxiliary optics 6, which emits a desired light pattern to the front. This light pattern is projected into the traffic space by means of a projection optics 8, which is a single-piece lens in the present case. Between the projection optics 8 and the lighting unit 2, a shielding screen 9 is arranged for shielding entering solar radiation, in which a light outlet aperture 10 is formed. In FIG. 2, it can be recognized that the individual parts are accommodated or held in housing 11, which is only roughly shown on a schematic level.

The headlamp 1 shown in FIGS. 1 and 2 corresponds to prior art with regard to the configuration of its shielding screen 9, and the problems of the undesired scattered light occurring here are explained in the following with regard to a principal beam path.

The beam path of the light emitted by the lighting unit 2 is indicated in FIG. 2 with $L_e$. This light or the beam path $L_e$ runs from the front side of the auxiliary optics 6 through the light outlet aperture 10 of the shielding screen 9 and through the projection optics 8 into the traffic space in front of the motor vehicle. Sunlight or sunbeams, which falls at an angle of about 45° in this example, are indicated with $L_s$ in FIG. 2. The incident sunbeams are bundled by the projection optics 8 and would, in the absence of the shielding screen 9, hit the front side of the auxiliary optics, where they could cause damage, namely by overheating components, such as the mount 7 for example, which is often made of heat-sensitive plastic. Such overheating cannot only cause damage, such as warping of adjusted elements, but even local fires, all the way to vehicle fires. In this context, one speaks of a burning-glass effect of the headlamp lenses.

However, if the sun is not too low, the sunbeams $L_s$ will hit the shielding screen, which may be heat-resistant, absorbent and/or reflective in correspondence with its purpose. In FIG. 2, light beams are indicated with $L_s'$ that would reach the lighting unit 2 without a shielding screen 9.

The shielding screen 9 does not affect those beams $L_e$ that are supposed to generate the light image on the road, but, in practice, the auxiliary optics 6, which is never perfect, will produce undesirable marginal beams $L_R$, which are deflected as scattered light $L_{RS}$ on the inner boundary surface 12 of the border 13 of the light outlet aperture 10 towards the projection optics 8 and enter into the areas of the light image, thereby causing unwanted artefacts.

In order to counteract this problem, the invention now provides for deflective structures to be formed on the border of the light outlet aperture of the shielding screen, in at least portion(s) thereof, which lead to a reduction of the scattered light resulting at the border.

Reference is now made to FIGS. 3 and 4, which show a first design of the deflective structures according to the invention. In accordance with FIG. 3, the light outlet aperture 10/its border 13 is formed in the shielding screen 9 so as to not cut off the desired light-generating beam path generating the light image. In the sectional view of FIG. 4, it can be recognized that the border 13 is tilted against the optical axis a at a specified angle so that an angled edge area 14 is formed. This angling of the border 13 does not necessarily have to be realized along the entire border; an angling in some areas is usually sufficient, preferably in the lower zone of the border. It is largely irrelevant whether the angling is toward the lighting unit 2 or toward the projection optics 8, which is explained in more detail below. In the sectional view in FIG. 4, the principle underlying the invention can be seen, which entails that marginal beams $L_R$ emanated by the lighting unit 2 or its auxiliary optics 6 are no longer reflected toward the projection optics on the inner boundary surface 12 of the border 13 of the light outlet aperture 10, which boundary surface now no longer runs horizontally. Unwanted light artefacts in the light image due to the marginal beams $L_R$ are thus avoided.

Concerning the extent of the angling, its angle must be large enough that the marginal beams $L_R$ that hit are not deflected to the front towards the projection optics 8. The minimum required angle will depend on the respective geometry of the arrangement, including the size of the light outlet aperture of the shielding screen, its thickness and the position of the shielding screen 9 in relation to the outlet surface of the auxiliary optics.

It should be pointed out that, in contrast to apertures, the shielding screens 9 that determine borders of the light image and should therefore be sharply depicted, is not located in the focal plane of the projection optics 8, but outside, in a meaningful way in front of this. Limitations of the light image are determined by the lighting unit 2 or the auxiliary optics 6 and not by the light outlet aperture 10 of the shielding screen 9. An example of a screen on the focal plane of the projection optics can be found in EP 2742282 B1 of the applicant.

Another embodiment of a deflection structure within the scope of the invention is now explained on the basis of FIGS. 5, 6 and 7. Also here, a light outlet aperture 10 with a border 13 is provided in the shielding screen 9, wherein this border has, in its upper portion and its lower portion, a plurality of spikes 15 for deflection of disturbing marginal beams $L_R$ arriving from the lighting unit 2. With regard to the enlarged depiction in FIG. 7, one can also call it a corrugated edge which alternately comprises spikes 15 and grooves 16. In FIGS. 5 to 7, two undesired marginal beams $L_R$ emitted by the lighting unit 2 are depicted, as well as two light beams $L_A$ scattered or deflected by the spikes 15. Most of these deflected light beams $L_A$ do not reach projection optics 8, so they will also not create disturbances in the light image. As can be recognized in FIG. 7, the term "spikes" should not necessarily entail "sharp" projections, but rather more generally projections, wherein typically on a longitudinal side of the light outlet aperture 20 to 400, usually 50 to 200 such projections are provided.

To give a practical example, which was implemented within the framework of the invention, it should be indicated that, in an example, the approximately rectangular light outlet aperture 10 of the shielding screen was 980 mm wide and 18 mm high and the spikes 15 had a height and width between 0.5 and 2 mm. Using FIGS. 8 and 9, which show a light distribution measured for a headlamp with the exemplary embodiment according to the invention—FIG. 8—or, for the same headlamp, without spikes 15 on the border of the light outlet aperture 10—FIG. 9—, one recognizes scattered light areas above and below the desired light image, from which the upper area is particularly pronounced. When applying the described embodiment according to the invention with spikes on the border—FIG. 8—the unwanted scattered light reaches a maximum luminous intensity of 162 cd, but 323 cd for an embodiment without spikes.

Based on FIGS. 10*a* to *f*, various embodiments of variants of the invention that have not all been discussed yet, will be explained below.

FIG. 10*a* again shows, in a detail of FIG. 2, the unwanted reflection of marginal beams $L_R$ to the front toward the projection optics, as deflected light beams $L_A$. FIG. 10*b* shows an embodiment in which the border of the shielding screen 9 comprises a bevelled edge 17 as a deflective structure at least in some portions, wherein the bevel running across the thickness of the shielding bevel 9 is tilted in towards the optical axis a and the lighting unit is tilted at a specified angle. Next, in FIG. 10*c*, the slope of this angle opposite to that of FIG. 10*b*, but in both cases, the incoming marginal beams $L_R$ are kept away from the projection optics as deflected light beams $L_A$.

Analogously to FIG. 4, FIG. 10*d* and FIG. 10*e* show angled edge portions, wherein the angling 18 in FIG. 10*d* runs towards the rear towards the lighting unit, in FIG. 10*e* however, to the front towards the projection optics. However, as can be seen from the beam path of the incoming marginal beams $L_R$ and the deflected light beams $L_A$, the effect of the deflective structure is comparable in both cases and similar to the bevels in FIG. 10*b* and FIG. 10*c*.

Finally, FIG. 10*f* shows an embodiment where the border is tapered at least in some portion(s) in the manner of a cutting edge 19, wherein, also here, the effect of a reduction of the scattered light is apparent since there is no flat area which could guide marginal beams $L_R$ as deflected light beams $L_A$ towards the projection optics, rather a bevelled edge 17 is effective as is the case in the embodiment according to FIG. 10*c*.

Although, in the scope of this description of the invention a special lighting unit 2 has been presented and described, namely a lighting unit for a so-called "matrix headlamp" with a larger number of LEDs and an auxiliary optics with light guides, it should be clear that the invention is by no means limited to a particular lighting unit. Neither an auxiliary optics nor a matrix-like arrangement of LEDs is required for implementing the invention, and likewise in place of LEDs other lighting means may be used, such as laser diodes with light converters, also combined with scanning laser beams, gas discharge lamps and the like.

| List of reference numbers | |
|---|---|
| 1 | headlamp |
| 2 | lighting unit |
| 3 | light source |
| 4 | circuit board |
| 5 | LEDs |
| 6 | auxiliary optics |
| 7 | mounting |
| 8 | projection optics |

-continued

| List of reference numbers | |
|---|---|
| 9 | shielding screen |
| 10 | light outlet aperture |
| 11 | housing |
| 12 | boundary surface |
| 13 | border |
| 14 | angled edge portion |
| 15 | spikes |
| 16 | grooves |
| 17 | bevelled edge |
| 18 | angling |
| 19 | cutting edge |
| $L_A$ | deflected light beams |
| $L_e$ | beam path |
| $L_R$ | marginal beams |
| $L_{RS}$ | scattered light |
| $L_s$ | sunbeams |

The invention claimed is:

1. A motor vehicle headlamp comprising:

a shielding screen (9) for shielding incident solar radiation, wherein the shielding screen is arranged between a lighting unit (2) having at least one light source (3) and a projection optics (8), said shielding screen having a light outlet aperture (10) for light radiated by the lighting unit to the front, wherein light emitted by the lighting unit is projected into traffic space as a light image by means of the projection optics, and the shielding screen is located outside the focal plane of the projection optics, wherein on a border (13) of the light outlet aperture (10) of the shielding screen (9), in at least a portion thereof, deflective structures (14, 15, 16, 17, 18, 19) are formed and configured to deflect scattered light emanating from the lighting unit and undesirable in the light image.

2. The motor vehicle headlamp according to claim 1, wherein the border (13) of the light outlet aperture (10) of the shielding screen (9) comprises a bevelled edge (17) in at least a portion thereof as at least one of the deflective structures, wherein the bevel extending across the thickness of the shielding screen is tilted towards an optical axis of the projection optics and the lighting unit at a specified angle.

3. The motor vehicle headlamp according to claim 1, wherein the border (13) of the light outlet aperture (10) of the shielding screen (9) is tilted in at least a portion thereof against an optical axis (a) of the projection optics, thereby being angled at a predetermined angle in an angling (18).

4. The motor vehicle headlamp according to claim 1, wherein the deflective structures are realized as a plurality of spikes (15) configured to deflect disturbing marginal beams ($L_R$) coming from the lighting unit (2).

5. The motor vehicle headlamp according to claim 4, wherein 20 to 400 spikes (15) are provided on one side of the border (13) along the longitudinal expansion of the light outlet aperture (10).

6. The motor vehicle headlamp according to claim 4, wherein 50 to 200 spikes (15) are provided on one side of the border (13) along the longitudinal expansion of the light outlet aperture (10).

7. The motor vehicle headlamp according to claim 1, wherein an auxiliary optics (7) is arranged in the beam path between the light source (3) and the shielding screen (9).

8. The motor vehicle headlamp according to claim 1, wherein the shielding screen (9) is arranged in front of the focal plane of the projection optics.

9. The motor vehicle headlamp according claim 1, wherein the light source (3) comprises a plurality of LEDs (5) arranged in a matrix.

10. The motor vehicle headlamp according to claim 1, wherein the shielding screen (9) is made of metal.

11. The motor vehicle headlamp according to claim 10, wherein the shielding screen (9) comprises a radiation-absorbing coating.

12. The motor vehicle headlamp according to claim 1, wherein the shielding screen (9) is made of plastic.

* * * * *